US008596170B2

(12) United States Patent
Yang

(10) Patent No.: US 8,596,170 B2
(45) **Date of Patent: *Dec. 3, 2013**

(54) SINGLE DIRECTION MECHANISM OF A RATCHET WRENCH

(76) Inventor: Cheng-Pu Yang, Changhua County (TW)

( * ) Notice: Subject to any disclaimer, the term of this patent is extended or adjusted under 35 U.S.C. 154(b) by 231 days.

This patent is subject to a terminal disclaimer.

(21) Appl. No.: 13/163,766

(22) Filed: Jun. 20, 2011

(65) Prior Publication Data

US 2012/0000323 A1 Jan. 5, 2012

(30) Foreign Application Priority Data

Jul. 2, 2010 (TW) ..... 99212576 U

(51) Int. Cl.
*B25B 13/46* (2006.01)

(52) U.S. Cl.
USPC ..... 81/60; 81/61

(58) Field of Classification Search
USPC ..... 81/60, 63.1, 63.2, 61
See application file for complete search history.

(56) References Cited

U.S. PATENT DOCUMENTS

| | | | | |
|---|---|---|---|---|
| 5,979,274 | A * | 11/1999 | Hsieh | 81/60 |
| 6,584,875 | B1 * | 7/2003 | Deng | 81/63.1 |
| 7,444,903 | B1 * | 11/2008 | Li | 81/60 |
| 8,051,747 | B1 * | 11/2011 | Tsai | 81/63.2 |
| 8,261,635 | B2 * | 9/2012 | Lee et al. | 81/60 |
| 8,291,792 | B2 * | 10/2012 | Yang | 81/63.2 |
| 8,297,152 | B2 * | 10/2012 | Hu | 81/63.1 |
| 2011/0100165 | A1 * | 5/2011 | Lee et al. | 81/60 |

* cited by examiner

*Primary Examiner* — David B Thomas

(57) ABSTRACT

The present invention discloses a single direction ratchet wrench which comprises a main body, a ratchet wheel, a pawl, an elastic element and a clip. The ratchet wheel and the pawl are lodged within the main body. The pawl has retaining cogs, concave surfaces and recess. One end of the elastic element is lodged within the second housing and the other end within the recess. The elastic element pushes the pawl with a particular angle so that the retaining cogs of the pawl are engaged with the ratchet teeth.

4 Claims, 6 Drawing Sheets

D-D

E-E

D-D

SINGLE DIRECTION MECHANISM OF A RATCHET WRENCH

FIELD OF THE INVENTION

The present invention relates to a ratchet wrench, particularly to a single direction ratchet wrench with lower manufacturing cost and durable mechanism.

BACKGROUND OF THE INVENTION

According to the prior art of a single direction ratchet wrench disclosed in U.S. Pat. No. 5,979,274, it comprises a main body whose two ends are one handle and one function end respectively. The function end has a first housing with a ratchet wheel allocated inside, a second housing caved in the inner wall of the first housing, a pawl confined in the second housing, and an elastic element lodged in a recess. When the elastic element pushes the pawl, the retaining cogs of the pawl and the ratchet teeth of the ratchet wheel are engaged together. Nevertheless, the recess to lodge the elastic element is drilled in the curved wall of the second housing. During manufacturing, the drill bit has to reach in the second housing with a bevel angle, in order to avoid contacting with the wall of the first housing, and drills a slanted recess from the curved wall of the second housing. Not only is the process difficult, but the elastic element lodged in the recess tends to be slantwise and poorly functioned.

Another prior art of a single direction ratchet wrench disclosed in U.S. Pat. No. 7,444,903 B1, it comprises a main body, a pawl, a ratchet wheel, a spring, a C-shape clip and a position ring. The main body has a first housing at its one end and a curved second housing in the wall of the first housing. An annular trough is at the top portion of the first housing and an annular flange at the bottom. The pawl is arc shaped. Its front side is a concave surface which has retaining cogs and a sliding surface successively arranged on it, and its rear side, opposite to the retaining cogs, has a limit surface and, opposite to the sliding surface, links with a spring. Both the top and the bottom portions of the ratchet wheel have an annular groove, and the two annular grooves allow the annular flange and the position ring to lodge in respectively. A C-shape clip clamps the ring and the groove tightly so that the ratchet wheel is positioned within the first housing by the concealed ring. This prior art does not require drilling a recess in the second housing to lodge the spring, but it still has following disadvantages:

1. It comprises six components: a main body, a pawl, a ratchet wheel, a spring, a C-shape clip and a position ring. The more the components are, and the higher the assembly cost is.

2. It still requires drilling a hole on the rear side of the pawl for the spring to be lodged. Because the rear side of the pawl is a curve, it makes the drilling much more difficult, especially at the summit of the curve. When the drill bit is spinning at a high speed and contacting with the surface of the curve, it is easily displaced along the curve. Therefore, it makes the drilling inaccurate as well and possibly damages the hole and the bit.

3. The spring is not able to effectively push the pawl and causes the pawl to inaccurately engage with the ratchet wheel, inasmuch as the recess to lodge the spring is located on the rear side, close to the middle portion, of the pawl.

4. The depth of the recess is limited, and so is the length of the spring. Therefore, the spring can only supply insufficient elasticity and cause the interaction between the pawl and the ratchet wheel uneven.

SUMMARY OF THE INVENTION

The object of the present invention is to provide a single direction ratchet wrench which has improved effectiveness of single direction control and also has advantages of simplified components, easier assembly and reduced cost. In order to achieve the foregoing object, a ratchet wheel comprises a main body, a ratchet wheel, a pawl, an elastic element and a C-shape clip. The function end of the main body has a first housing and a second housing for the ratchet wheel and the pawl to be confined within respectively. There are a clamping trough and an annular groove notched at the top and the bottom peripheries of the ratchet wheel respectively. The clamping trough is exactly paired with an annular trough for the clip to clamp and the annular groove allows an annular flange to be engaged, at the bottom of the first housing, for the ratchet wheel to be rotatably lodged within the first housing. A plurality of retaining cogs and a first concave surface are successively arranged on the front side of the pawl, and they are distributed along a first arc. The central angle of the first concave surface extended along the first arc is less than 15 degrees, and a curved limit piece is smoothly extended from the end of the first concave surface. On the rear side of the pawl is a first convex surface whose one end extends a second convex surface and the other end extends a recess. The second convex surface abuts against the wall of the second housing, and the recess is formed by the opposite side of the curved limit piece for one end of the elastic element to lodge in. The second convex surface spans between 10 to 20 degrees of the first arc's central angle, and it is on a second arc. Between the distal end of the limit piece and the second arc is a gap which is larger than the depth of the retaining cogs. The central angle spanned from the center of the recess to the middle of the first convex surface is between 15 to 35 degrees of the first arc.

DETAILED DESCRIPTION OF THE PREFERRED EMBODIMENT

Figure 1:
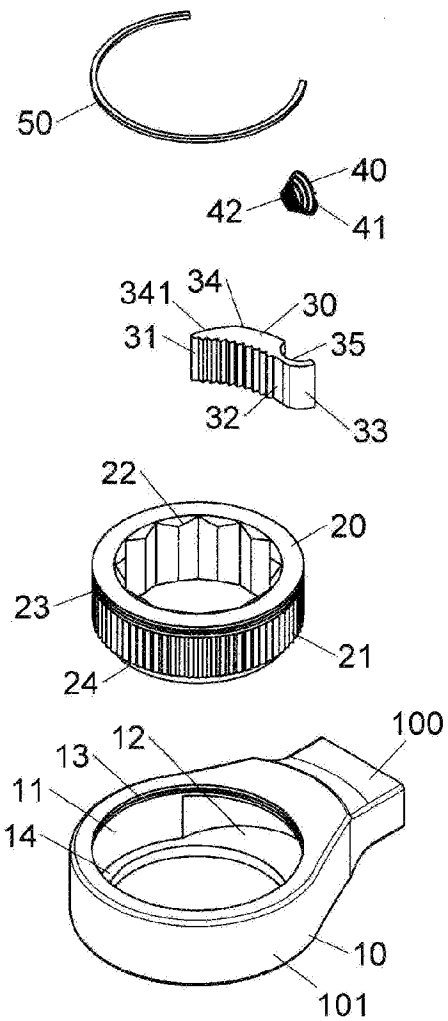
FIG. 1 is an exploded perspective view of the present invention.
Figure 2:
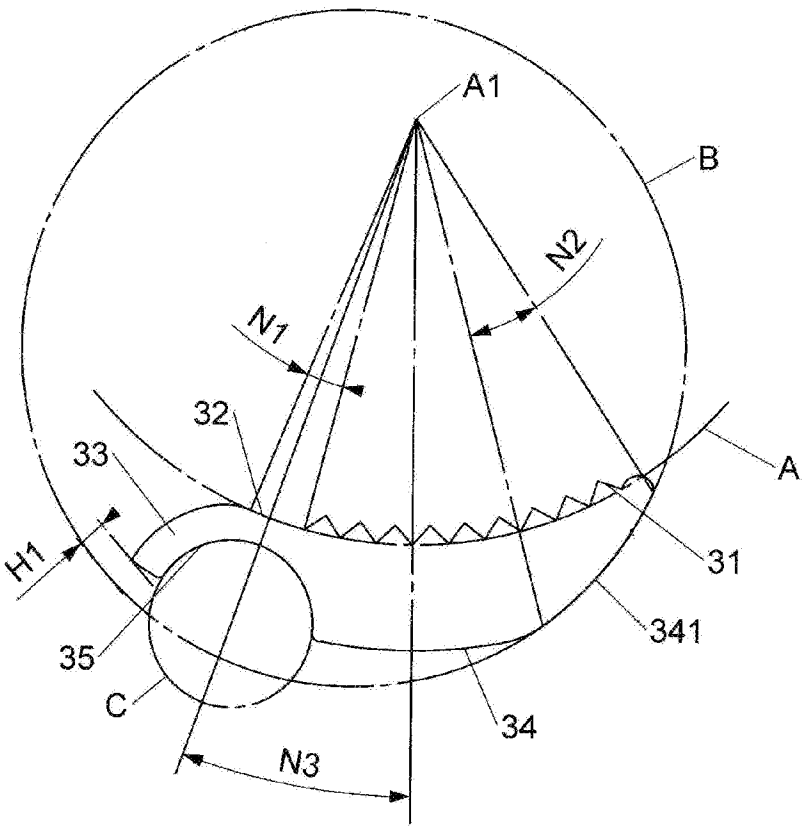
FIG. 2 is a schematic drawing of the pawl in accordance with the present invention.
Figure 3:
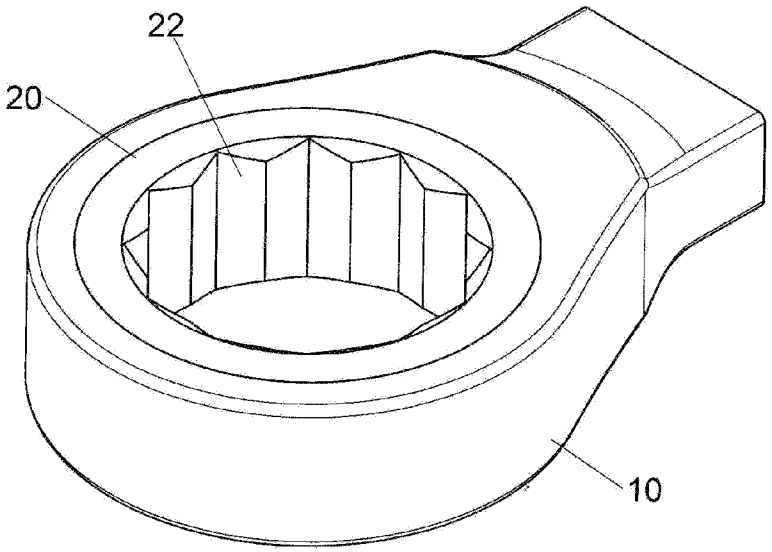
FIG. 3 is a perspective assembly view of the present invention.

Referring to FIGS. 1 to 3, the single direction ratchet wheel of the present invention comprises a main body 10, a ratchet wheel 20, a pawl 30, an elastic element 40 and a clip 50. Their mechanism is detailed as below.

The main body 10 has a handle 100 at one end and a function end 101 at the other. The function end 101 has a round first housing 11 axially penetrating the function end 101. The inner wall of the first housing 11 close to the handle 100 has a depressed and curved second housing 12 which communicates with the first housing 11 and has a smaller diameter than the first housing 11. The center of the second housing 12 is located inside the first housing 11 and the top and the bottom portions of the second housing 12 are confined and closed respectively. An annular trough 13 is provided at the top portion of the first housing 11, and an annular flange 14 is provided at the bottom.

The ratchet wheel 20 is rotatably mounted in the first housing 11. The outer periphery of the ratchet wheel 20 has a plurality of ratchet teeth 21 annularly arranged at its middle portion. The center of the ratchet wheel 20 has a couple portion 22 which, shown as drawings, is a polygonal opening for a workpiece to be coupled. A clamping trough 23 and an annular groove 24 are respectively notched at the top and the bottom portions of the outer peripheries of the ratchet wheel 20. The clamping trough 23 is exactly paired with the annular trough 13, and the annular groove 24 allows the annular flange 14 to be engaged in.

The pawl 30 is lodged in the second housing 12 having a plurality of retaining cogs 31 and a first concave surface 32 is successively arranged on its front side and distributed along a first arc A. The first arc A has the same diameter as the first housing 11. The retaining cogs 31 are defined to engage with the ratchet teeth 21. The central angle N1 of the first concave surface 32 extending along the first arc A is less than 15 degrees of the central angle of the first arc A. A curved limit piece 33 is smoothly extended from the distal end of the first concave surface 32. On the rear side of the pawl 30 is provided a first convex surface 34 whose one end extends a second convex surface 341 adjacent to the front side of the pawl 30 and the other end extends a recess. The second convex surface 341 spans between 10 to 20 degrees of the central angle N2 along the first arc A and is against the second housing 12 and located on a second arc B as well. The second arc B has the same diameter as the second housing 12. Between the distal end of the limit piece 33 and the second arc B is provided a gap H1 which is larger than the depth of the retaining cogs 31. The central angle spanned from the center of the recess 35 to the middle of the first convex surface 34 is between 15 to 35 degrees of the central angle of the first arc A.

The elastic element 40 has a first end 41 and a second end 42. The outer diameter of the first end 41 is greater than or equal to the vertical depth of the second housing 12 in order for the first end 41 to be held against the second housing 12 and for the second end 42 to be held within the recess 35 of the pawl 30, and the elastic element 40 pushes the pawl 30 so that the second convex surface 341 is forced to abut against the wall of the second housing 12 and the retaining cogs 31 of the pawl 30 are engaged with the ratchet teeth 21.

The clip 50 is lodged in both the annular trough 13 and the clamping trough 23 for the ratchet wheel 20 to be held within the first housing 11.

Figure 4:
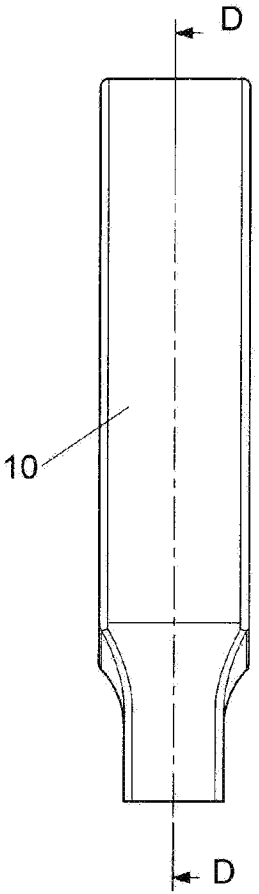
FIG. 4 is a side view of the present invention.
Figure 5:
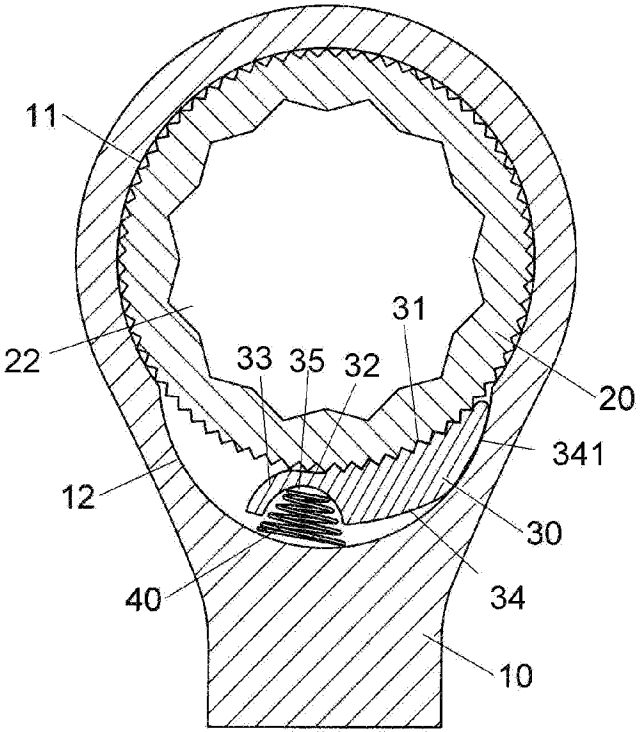
FIG. 5 is a cross sectional view taken along plane D-D in FIG. 4.

Referring to FIGS. 4 and 5, the ratchet wheel 20 is rotatably mounted in the first housing 11 of the main body 10 and the pawl 30 is lodged within the second housing 12. The first end 41 of the elastic element 40 is held against the wall of the second housing 12 and the second end 42 is held within the recess 35 of the pawl 30. The second convex surface 341 is abutted against the second housing 12 and the retaining cogs 31 of the pawl 30 are engaged with the ratchet teeth 21.

Figure 6:
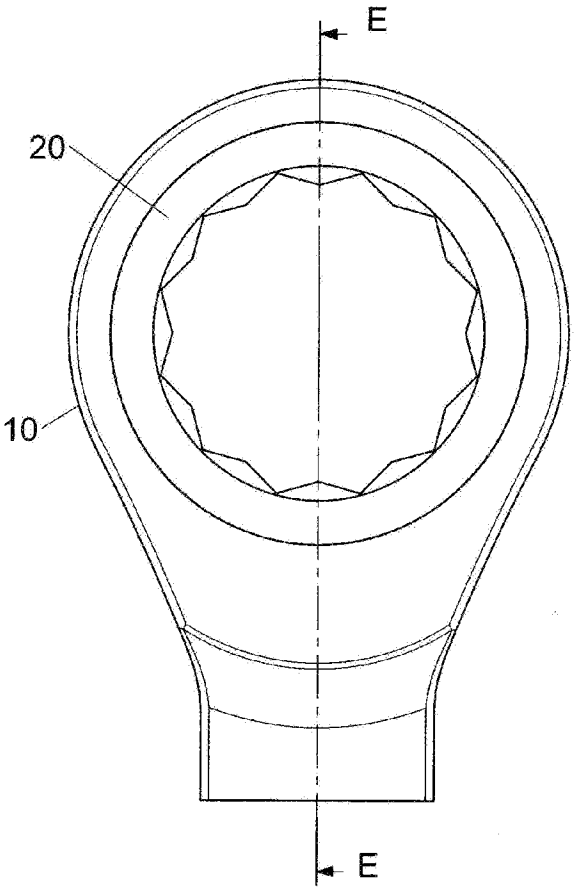
FIG. 6 is a front view of the present invention.
Figure 7:
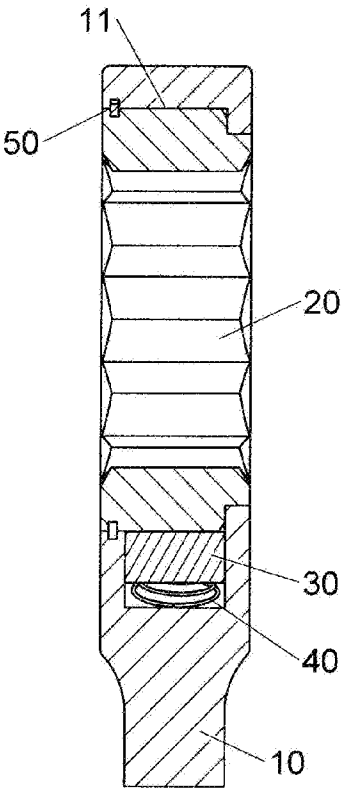
FIG. 7 is a cross sectional view taken along plane E-E in FIG. 6.

Referring to FIGS. 6 and 7, the clamping trough 23 is exactly paired with the annular trough 13 and the annular groove 24 allows the annular flange 14 to be engaged in. The clip 50 is lodged in both the annular trough 13 and the clamping trough 23. The ratchet wheel 20 is rotatably positioned in the first housing 11.

Referring to FIGS. 1 and 2, the cross section of the recess 35 is an arc and the elastic element 40 is tapered with the outer diameter of the first end 41 greater than the outer diameter of the second end 42.

Figure 8:
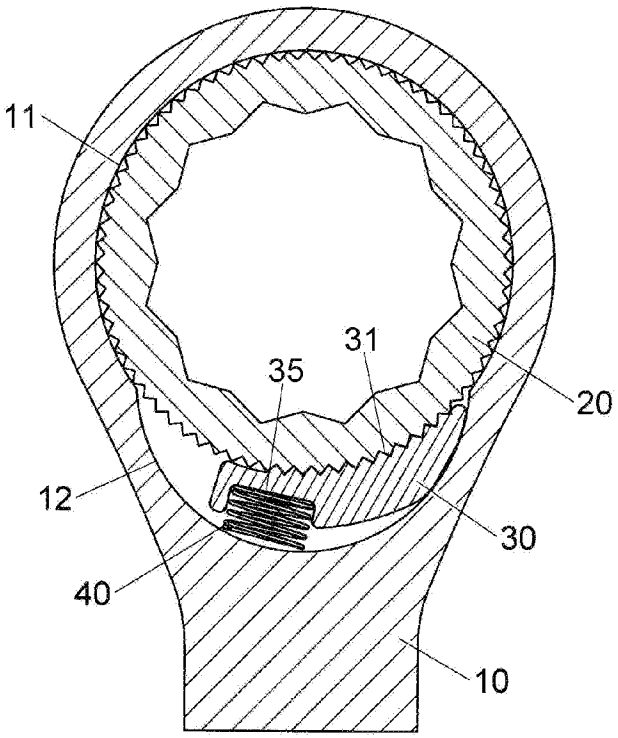
FIG. 8 is another cross sectional view of an embodiment in accordance with the present invention.

Referring to FIG. 8, the cross section of the recess 35 is U shaped and the elastic element 40 has a fixed outer diameter.

Based upon above designs, the advantages of the present invention are summarized as below:

1. In the present invention, the mechanism of the ratchet wheel comprises only five components: a main body 10, a ratchet wheel 20, a pawl 30, an elastic element 40 and a clip 50. Comparing with the design disclosed in the U.S. Pat. No. 7,444,903 B1, the cost of components can be reduced.

2. In the present invention, the recess 35 is deep and its cross section is an arc. The elastic element 40 is tapered with a longer length and it pushes the pawl 30 with an N3 angle. Therefore, the bevel elasticity can easily make the second convex surface 341 tightly abut against the wall of the second housing 12 and make the retaining cogs 31 engage with the ratchet teeth 21 more precisely.

3. In the present invention shown as FIG. 2, the pawl 30 has a recess 35 for the elastic element 40 to be lodged in. The pawl 30 is one-piece manufactured. It does not require drilling, so the cost of manufacturing can be reduced.

4. In the present invention shown as FIG. 7, the diameter of the first end 41 of the elastic element 40 matches the width of the second housing 12 and the second end 42 lodges within the recess 35. It does not require drilling a hole from another component to lodge the elastic element 40, and the elastic element 40 can be steadily lodged within the second housing 12.

5. In the present invention, the pawl 30 has a second convex surface 341 which is steadier abutted against the second housing 12 with an N1 angle.

6. In the present invention, the cross section of the recess 35 of the pawl 30 is designed to be an arc for easier manufacturing.

While we have shown and described the embodiment in accordance with the present invention, it should be clear to those skilled in the art that further embodiments may be made without departing from the scope of the present invention.

What is claimed is:

1. A single direction ratchet wheel comprising:

a main body having a handle at one end and a function end at the other end, the function end having a round first housing opened in its middle, the inner wall of the first housing being defined a curved second housing thereon, the center of the second housing being located inside the first housing, both the top and the bottom portions of the second housing being confined, and an annular trough being at the top portion of the first housing and an annular flange being at the bottom;

a ratchet wheel being rotatably mounted in the first housing, the outer periphery of the ratchet wheel having a plurality of ratchet teeth annularly arranged at its middle portion, the center of the ratchet wheel having a couple portion, a clamping trough and an annular groove being respectively notched at the top and the bottom portions of the ratchet wheel, the clamping trough being exactly paired with the annular trough, and the annular groove allowing the annular flange to be engaged in;

a pawl lodged in the second housing having a plurality of retaining cogs and a first concave surface successively arranged on its front side and distributed along a first arc; the first arc having the same diameter as the first housing, the retaining cogs being defined to engage with the ratchet teeth; the central angle of the first concave surface extended along the first arc being less than 15 degrees and a curved limit piece being smoothly extended from one distal end of the first concave surface; on the rear side of the pawl being a first convex surface whose one end extends a second convex surface adjacent to the front side of the pawl and the other end extends a recess; the second convex surface spanning between 10 to 20 degrees of the central angle along the first arc, and being against the second housing and locating on a second arc as well; the second arc having the same diameter as the second housing, between the distal end of the limit piece and the second arc being defined a gap which is larger than the depth of the retaining cogs, and the central angle spanned from the center of the recess to the middle of the first convex surface being between 15 to 35 degrees of the central angle of the first arc;

an elastic element having a first end and a second end, the outer diameter of the first end being greater than or equal to the vertical depth of the second housing in order for the first end to be held against the second housing and for the second end to be held within the recess, and the elastic element pushing the pawl so that the second convex surface being forced to abut against the wall of the second housing and the retaining cogs of the pawl being engaged with the ratchet teeth; and a C-shape clip being lodged in both the annular trough and the clamping trough for the ratchet wheel to be held within the first housing.

2. The single direction ratchet wheel as claimed in claim 1, wherein the cross section of the recess is U shaped and the elastic element has a fixed outer diameter.

3. The single direction ratchet wheel as claimed in claim 1, wherein the cross section of the recess is an arc and the elastic element is tapered with the outer diameter of the first end greater than the outer diameter of the second end.

4. The single direction ratchet wheel as claimed in claim 1, wherein the couple portion is a polygonal opening for a workpiece to be coupled.

* * * * *